US006393817B1

(12) United States Patent
Coró

(10) Patent No.: US 6,393,817 B1
(45) Date of Patent: May 28, 2002

(54) METHOD AND RELATIVE EQUIPMENT FOR COUPLING AN ELASTOMERIC YARN TO AN INEXTENSIBLE YARN

(75) Inventor: Paolo Coró , Solbiate Arno (IT)

(73) Assignee: Fadis S.p.A., Varese (IT)

( * ) Notice: Subject to any disclaimer, the term of this patent is extended or adjusted under 35 U.S.C. 154(b) by 0 days.

(21) Appl. No.: 09/412,711

(22) Filed: Oct. 5, 1999

(30) Foreign Application Priority Data

Oct. 6, 1998 (IT) ..... MI98A2143

(51) Int. Cl.[7] ..... D01H 7/92

(52) U.S. Cl. ..... 57/290; 57/6; 57/200; 57/205; 57/207; 57/226; 57/245; 57/288; 57/350; 28/271

(58) Field of Search ..... 28/271; 57/6, 290, 57/200, 205, 207, 226, 245, 288, 350

(56) References Cited

U.S. PATENT DOCUMENTS 4,296,597 A * 10/1981 Tani et al. ..... 57/205
5,008,992 A * 4/1991 Gehrmann et al. ..... 28/271
5,560,192 A * 10/1996 Frith ..... 57/226
5,568,719 A * 10/1996 Proctor ..... 57/225

* cited by examiner

*Primary Examiner*—John J. Calvert
*Assistant Examiner*—Shaun R Hurley
(74) *Attorney, Agent, or Firm*—Herbert Dubno

(57) ABSTRACT

Machine for combining an elastomer thread (81) with an unextendable thread (11) wound on respective spools (80, 10), which comprises a first pair (20) of rollers for driving the unextendable thread (11), a heating oven (30), a false-twisting group (40), a second pair (50) of driving rollers and at least one interlacing device (60), which are arranged in sequence along the path of the thread (11), characterized in that said elastomer thread (81) is supplied upstream of the said false-twisting group (40).

2 Claims, 1 Drawing Sheet

METHOD AND RELATIVE EQUIPMENT FOR COUPLING AN ELASTOMERIC YARN TO AN INEXTENSIBLE YARN

DESCRIPTION

The present invention relates to a method for combining an elastomer thread with an unextendable thread and to an associated machine for implementing the method, in which said elastomer thread is supplied upstream of the group performing false twisting of the two threads. It is known that in the art of producing yarns for weaving there exists the need to elasticize these yarns by combining an elastomer thread with the thread of unextendable fabric.

The known techniques for performing this combining operation basically consist of two types, i.e. so-called:

interlacing: performed by means of air devices which combine the thread and elastomer, both of which have already been pre-stretched/texturized separately. Although sufficiently fast, this method requires two separate apparatus for the separate preliminary processing and the subsequent combination of the unextendable thread and the elastomer thread, with the consequent need for intermediate spooling and transfer of the spools from one machine to the other, resulting in long cycle idle times. In addition to this, the method of air interlacing is unable to guarantee a high quality of finish of the final yarn (so-called velvet touch) which is wound onto the spool to be transferred for subsequent processing;

overlaying: based on a machine which unwinds an unextendable thread from a special reel which has been prepared beforehand and at the same time winds it spirally onto an elastomer yarn. Although this method is able to achieve a much higher quality of the final yarn, it is, however, slow and requires an intermediate step for preparation of the special reels which are obtained by winding the unextendable thread removed from a spool of already pre-stretched/texturized thread onto another machine, with a consequent increase in the time and costs for production of the elasticized yarn. The technical problem which is posed, therefore, is that of providing an elasticized yarn obtained from the combination of a thread of unextendable fabric with an elastomer thread, by means of a method and an associated machine which are able to operate at much higher speeds and obtain at the same time a high final quality of the elasticized yarn.

Within the scope of this problem a further requirement is that the method should be able to be implemented by means of a single simplified and compact machine which reduces to a minimum the intermediate steps of preliminary processing of the yarn and the elastomer and the need to have intermediate spools and/or reels. These technical problems are solved according to the present invention by a method for combining an elastomer thread with an unextendable thread and an associated machine for implementing the method, in which said unextendable thread is supplied upstream of the group for false twisting the two threads.

Further details may be obtained from the following description of a non-limiting example of embodiment of the invention provided with reference to the accompanying drawings in which.

Figure 1:
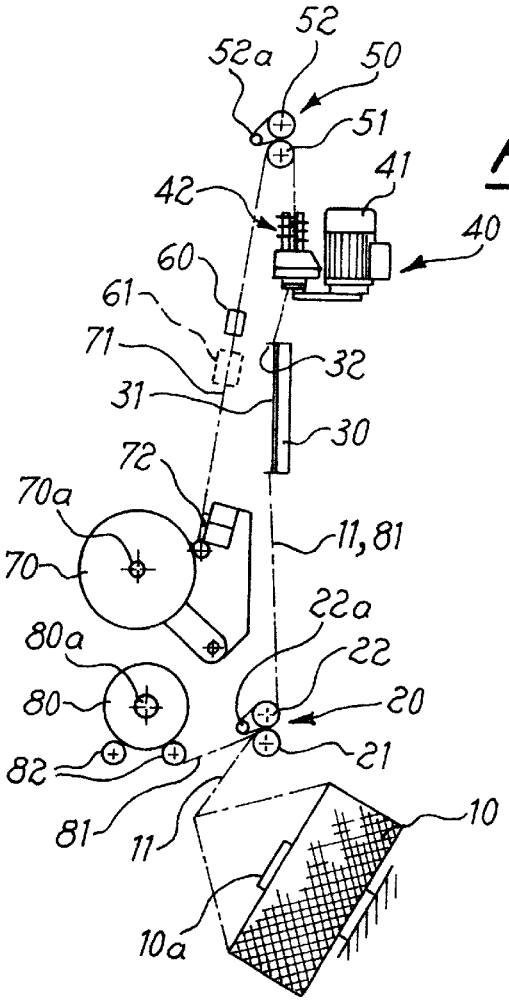
FIG. 1 shows the working diagram of a first example of embodiment of the machine according to the invention.

As shown in FIG. 1, the machine according to the invention comprises in succession:

a first spool 10 which is mounted on a fixed spool carrier 10*a* and on which the thread 11 of unextendable fabric, for example of the type which is referred to in the sector as "POY", is wound;

a first pair 20 of rollers for driving the thread 11;

a heating oven 30;

a group 40 for false twisting the thread;

a second pair 50 of rollers for driving the thread 11;

a first compressed-air device 60 for interlacing, and;

a spool 70 for storing the yarn 71 elasticized by means of an elastomer thread 81 which is supplied from;

a spool 80 which is arranged upstream of the said first pair 20 of rollers for driving the thread 11 and on which the said thread 81 is wound.

More particularly the first pair 20 driving the thread 11 comprises a first motorized roller 21 and a second idle rubber roller 22 which is associated with a further pressure roller 22*a*.

The motorized roller 21 rotates at a predefined speed which is determined in relation to the type and the fineness of the yarn to be combined.

The spool 80, on which the elastomer thread 81 is wound, is in turn mounted idle on a shaft 80*a* and is actuated by means of motorized rollers 82 which are brought into contact with the spool itself.

The heating oven 30 is of the conventional type and is therefore only schematically shown with a plate 31 and with yarn-guiding elements 32, as is the false-twisting group 40 which comprises a motor 41 actuating a series of ceramic discs forming the spindle 42, passing over which the thread undergoes the programmed false twisting.

The second pair of driving rollers 50 comprises in turn a first motorized roller 51 and a second driven roller 52 which is associated with a corresponding pressure roller 52*a*.

The pair of rollers 50 rotates at a speed which is greater than that of the pair of rollers 20 so that stretching of the threads occurs along the path section between the two pairs of rollers 20 and 50.

The interlacing device 60 is of the conventional air type and therefore not described in detail.

FIG. 1, however, shows in broken lines a second device 61 of the type known as "turbo-jet" which may be activated in series with and/or as an alternative to the first device.

The spool 70 for storing the elasticized yarn 71 is mounted on a motorized shaft 70*a* and associated with a yarn-guiding group 72 which is conventional per se.

The operating principle of the machine is as follows:

The unextendable thread 11 and the elastomer thread 81 are made to pass at the same time through the first pair 20 of driving rollers, the oven 30, the false-twisting group 40, the second pair of rollers 50, the air interlacing device 60 and the yarn-guiding device 72.

Operation of the motorized rollers 21,51 and the spool 70 causes the thread 11 and the elastomer 71 to pass continuously through the said devices and, as they pass through, they are simultaneously stretched, subjected to false twisting, interlaced and finally stored on the spool 70.

It should be emphasized that the elastomer undergoes pre-stretching along the path section between the spool 80 and the first pair of driving rollers 20.

As explained in the example of embodiment according to FIG. 1, the elastomer 81 enters into the oven 30 together with the thread 11, the temperature of the oven must therefore be precisely controlled since the elastomer is a synthetic fibre which melts at 160° C.; despite this fact, hot-working is preferred since it facilitates interlacing of the two threads and the tensions in the thread itself are reduced considerably, enabling the final quality thereof to be further improved.

Figure 2:
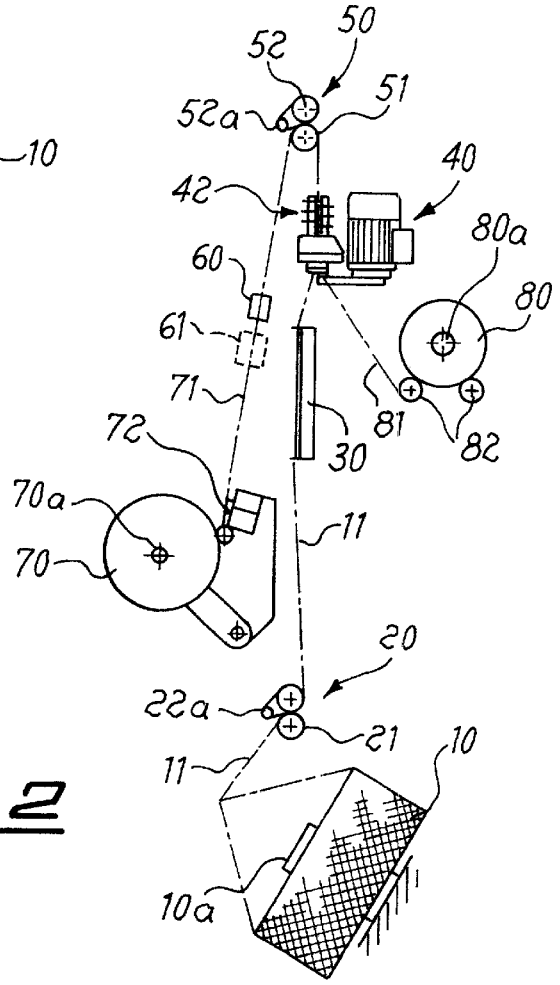
FIG. 2 shows the working diagram of a second embodiment of the machine according to the invention.

Should, however, stretching of the thread 11 be performed at very high temperatures (180°–250°) on account of the particular characteristics of the thread itself, it is also possible to envisage a machine configuration as shown in FIG. 2.

According to this configuration, the elastomer thread 81 is supplied downstream of the oven 30 and upstream of the false-twisting group 40; in this way it is ensured that the elastomer retains its properties of elasticity.

It should be pointed out, moreover, that in this second embodiment the elastomer does not undergo any prestretching as in the case of FIG. 1.

The machine described above basically implements a novel method according to the invention which envisages the following steps:

supplying of an unextendable thread 11 to a first pair 20 of driving rollers, to a heating oven 30, to a false twisting group 40, to a second pair 50 of driving rollers rotating at a higher speed than that of the first pair 20, and to an interlacing device, preferably of the air type;

simultaneous supplying, upstream of the false-twisting group, of an elastomer thread 81 to be interlaced with the unextendable thread 11;

winding of the elasticized thread 71 onto a storage spool 70.

In a preferred embodiment of the method according to the invention, the elastomer thread 81 is supplied upstream of the first pair 20 of driving rollers so that it may be hot-stretched together with the unextendable thread 11.

In the practical implementation of the method, the speed of the driving rollers 50 is fixed, whereas the speed of the rollers 20 varies depending on the stretching characteristics required.

It is therefore obvious how, with the method and the machine according to the invention, it is possible to obtain an elasticized yarn, composed of an unextendable thread and an elastomer thread, at a speed which is substantially equivalent to that of the interlacing method known in the art, but with a final quality of the interlaced yarn which is substantially equivalent to that of the overlaying method, all of which using a single compact machine which performs the entire cycle without interruptions or the need for changes in the format of the spools or even transfer thereof from one machine to another. In other words, with the method and the machine according to the invention, it is possible to obtain a high-quality elasticized yarn at a low cost owing to the processing speed which can be achieved and the reduction in the cycle idle time typical of the known techniques which require the winding of the threads onto intermediate spools designed for the specific machine which performs the individual operation.

I claim:

1. A method of making a yarn having a velvet feel, comprising the steps of:

passing an inextensible thread in succession through a first pair of rollers, a heating oven, a false-twisting device, a second pair of rollers, and an interlacing device to a yarn-takeup spool; supplying an elastomer thread;

prestretching said elastomer thread;

combining the prestretched elastomer thread with said inextensible thread on said first pair of rollers and upstream of said false-twisting device to form a yarn therewith;

imparting a false twist in said false-twisting device to said yarn formed upstream of said false-twisting device;

subjecting said yarn to air interlacing said interlacing device; and stretching said yarn by rotating said second pair of rollers at a greater speed than said first pair of rollers.

2. An apparatus for making a yarn having a velvet feel, comprising:

a first pair of rollers for advancing an inextensible thread;

a heating oven downstream of said first pair of rollers and traversed by said inextensible thread;

a false-twisting device downstream of a heating oven for imparting false twist to a yarn containing said inextensible thread;

a second pair of rollers downstream of said false-twisting device and operated at a speed greater than the speed of said first pair of rollers for stretching said yarn;

an interlacing device for subjecting yarn to air interlacing downstream of said second pair of rollers;

a yarn takeup spool downstream of said interlacing device for winding up said yarn; and a supply of an elastomer thread provided with a device for feeding said elastomer thread to said inextensible thread at said first pair of rollers for combination with said inextensible thread to form said yarn at a location upstream of said false-twisting device, said device including means for prestretching said elastomer thread before it passes through said first pair of rollers.

* * * * *